US008230643B2

(12) United States Patent
Chang

(10) Patent No.: US 8,230,643 B2
(45) Date of Patent: Jul. 31, 2012

(54) PLANTING SLOPE STRUCTURE

(76) Inventor: Yushun Chang, Guang Dong (CN)

( * ) Notice: Subject to any disclaimer, the term of this patent is extended or adjusted under 35 U.S.C. 154(b) by 814 days.

(21) Appl. No.: 12/302,016

(22) PCT Filed: Jun. 1, 2006

(86) PCT No.: PCT/CN2006/001174

§ 371 (c)(1),
(2), (4) Date: Nov. 21, 2008

(87) PCT Pub. No.: WO2007/137455

PCT Pub. Date: Dec. 6, 2007

(65) Prior Publication Data

US 2010/0212559 A1 Aug. 26, 2010

(51) Int. Cl.
*A01G 9/02* (2006.01)
*A01G 17/00* (2006.01)

(52) U.S. Cl. ..... 47/1.01 T; 47/65.8; 47/66.1; 47/66.3; 47/66.5

(58) Field of Classification Search ..... 111/200; 47/1.01 R, 1.01 F, 1.01 T, 58.1 R, 58.1 SC, 47/58.1 SE, 904, 65.5, 65.7–65.9, 66.1, 66.3–66.7, 47/73, 77, 78, 83, 86, 87; 405/15, 258.1, 405/270, 302.3, 302.4, 302.6, 302.7
See application file for complete search history.

(56) References Cited

U.S. PATENT DOCUMENTS 6,824,684 B2 11/2004 Prince

FOREIGN PATENT DOCUMENTS

| | | | | |
|---|---|---|---|---|
| CN | 1689393 | A | * | 11/2005 |
| CN | 283917 | Y | * | 11/2006 |
| JP | 56-115422 | A | * | 9/1981 |
| JP | 146290 | A | * | 5/1994 |
| JP | 09-088038 | | | 3/1997 |
| JP | 09-313013 | | | 12/1997 |
| JP | 2003-47330 | A | * | 2/2003 |

OTHER PUBLICATIONS

New Zealand Examination Report.
Vietnam Examination Report dated Jul. 26, 2011.
Canadian Examination Report dated Jul. 5, 2011.

* cited by examiner

*Primary Examiner* — Christopher J. Novosad
(74) *Attorney, Agent, or Firm* — Wood, Phillips, Katz, Clark & Mortimer

(57) ABSTRACT

A slope planting structure includes containing bags laid on the surface of a slope, stuffing filled in the containing bags, and fasteners. The containing bags are provided with plant seeds. The stuffing composed of plant growing material and absorbent material is filled into the containing bags. The containing bags are laid on the surface of the slope, and then the fasteners are inserted through the containing bags to secure the containing bags on the slope. The containing bags are integrated with the slope to secure the slope, providing protection and green effects.

14 Claims, 9 Drawing Sheets

PLANTING SLOPE STRUCTURE

BACKGROUND OF THE INVENTION

1. Field of the Invention

The present invention relates to a planting slope structure, and more particularly to one having slope protection and green effects.

2. Description of the Prior Art

A conventional slope structure is composed of cement, stone, steel bar, sand, and earth. The process of construction is complicated. It needs fixing mold plates by manpower for pouring concrete. After pouring concrete, the concrete needs protection for shaping and solidifying. Besides, after the slope is completed, the slope needs vegetation, i.e. landscape engineering, to prevent the soil on the surface of the slope from being washed away by rain. The conventional concrete slope structure is not pervious to water. Therefore, it needs an additional system to drain water. The effect to drain water is not perfect because the system may be blocked by earth and stones, causing the soil on the surface to be washed away by rain. Sometimes, the soil of the slope contains abundant water, causing mudflows and landslides to destroy the slope structure.

Thus it can be seen, the conventional slope structure is complicated and time-consuming. The concrete structure is not environmental and beautiful, and is easy to be damaged. Besides, the conventional slope structure causes destruction to ecology.

SUMMARY OF THE INVENTION

The present invention is to overcome the shortcomings of the prior art. The primary object of the present invention is to provide a slope planting structure for plant growing so as to achieve environmental protection and beauty effects and to secure and protect the slope.

According to the present invention, there is provided a slope planting structure, comprising containing bags laid on the surface of a slope, stuffing filled in the containing bags, and fasteners, the containing bags being provided with plant seeds, the stuffing comprising plant growing material and being filled into the containing bags, the containing bags being laid on the surface of the slope, the fasteners being inserted through the containing bags to secure the containing bags on the slope, the containing bags being integrated with the slope to secure the slope for providing protection and greening.

The plant seeds are sprinkled on the surface of the containing bags, mixed with the stuffing and filled into the containing bags, or disposed between every two of the containing bags.

The containing bags are ventilative and pervious to water for plant growing.

The plant growing material of the stuffing is soil, organic soil or any material to assist plant growing.

The stuffing further comprises absorbent material. The absorbent material is absorbent resin in order to keep moisture for the plants.

Each of the fasteners is a bullet head nail, a bulged nail, a spiral nail, or a nail with a spacer. Each of the fasteners may have a hook, depending on the demand. The fasteners are to secure the containing bags on the slope firmly.

Each of the containing bags is made in the form of a unitary block or a unitary rod. The containing bags made in the form of a unitary rod are arranged longitudinally from an upper end of the slope to a lower end of the slope. The bottoms of the containing bags are covered with soil. The containing bags made in the form of a unitary rod may be arranged transversally from an inclination of the slope to a side of the slope. A connecting buckle is provided between every two of the containing bags for connecting and securing the containing bags transversally. The connecting buckle comprises a protrusion or a protrusion having a hook to connect the tops or the bottoms of every two of the containing bags. The connecting buckle may have a central hole. The central hole of the connecting buckle is adapted for insertion of the fastener.

Compared to the prior art, the present invention has the following advantages.

1. The present invention covers an entire slope or a partial slope to provide a green layer for plant growing, securing and protecting the slope as well as greening and beautifying the slope.
2. The materials of the present invention are made of environmental materials, which can be used on any natural slope, such as cement, stone or earth, to provide a green ecology, to improve the air and to absorb heat and noise.

DETAILED DESCRIPTION OF THE PREFERRED EMBODIMENTS

Embodiments of the present invention will now be described, by way of example only, with reference to the accompanying drawings.

Figure 1:
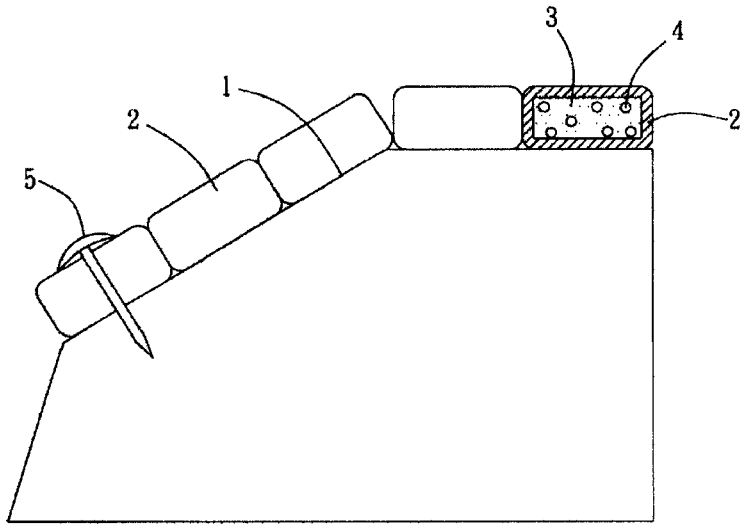
FIG. 1 is a schematic view of a first preferred embodiment of the present invention.

As shown in FIG. 1, a slope planting structure according to a first preferred embodiment of the present invention comprises a number of containing bags 2 laid on the surface of a slope 1, stuffing 3 filled in the containing bags 2, a number of plant seeds 4, and a number of fasteners 5.

The containing bag 2 is made in the form of a unitary block, which is ventilative and pervious to water. The stuffing 3 will not ooze from the containing bag 2, and the soil outside the bag will not permeate into the bag. The containing bag 2 is filled with the stuffing 3. The stuffing 3 is a mixture of plant growing material and absorbent material.

The plant growing material in the stuffing 3 is soil or organic soil. The absorbent material in the stuffing 3 is absorbent resin. In this embodiment, the plant seeds 4 are mixed in the stuffing 3. The plant growing material and absorbent material in the stuffing 3 provide essential nutrients and moisture to the plant seeds 4 for sprouting. The roots of the plants will extend downward and pass through the bottom of the containing bag 2 into the soil of the slope 1, while the stems and leaves of the plants will extend upward and pass through the top of the containing bag 2.

To practice the present invention, the stuffing 3 composed of plant growing material and absorbent material and the plants seed 4 are filled into the containing bag 2 to form a unitary block. The containing bags 2 are laid on the surface of the slope 1. At least one fastener 5 is inserted through the containing bag 2 to secure the containing bag 2 on the slope 1. The containing bags 2 are integrated with the slope 1, providing a slope protection effect and making green by planting.

Figure 8E:
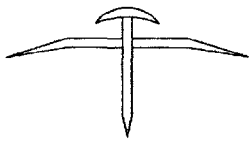
FIGS. 8*a*~8*e* are schematic views of fasteners of the present invention.
Figure 8D:
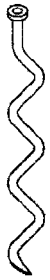
Figure 8C:
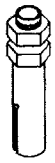
Figure 8B:
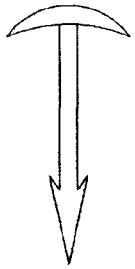
Figure 8A:
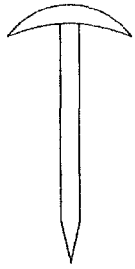

Referring to FIGS. 8*a*~8*e*, the fasten 5 may be a nail (as shown in FIG. 8*a*), a nail having a hook (as shown in FIG. 8*b*), a bulged nail (as shown in FIG. 8*c*), a spiral nail (as shown in FIG. 8*d*), or a nail with a spacer 51 (as shown in FIG. 8*e*). The fastener 5 is inserted through the containing bag 2 to prevent the bags from scatting and to prevent the occurrence of a gap, accomplish a whole slope structure.

Figure 2:
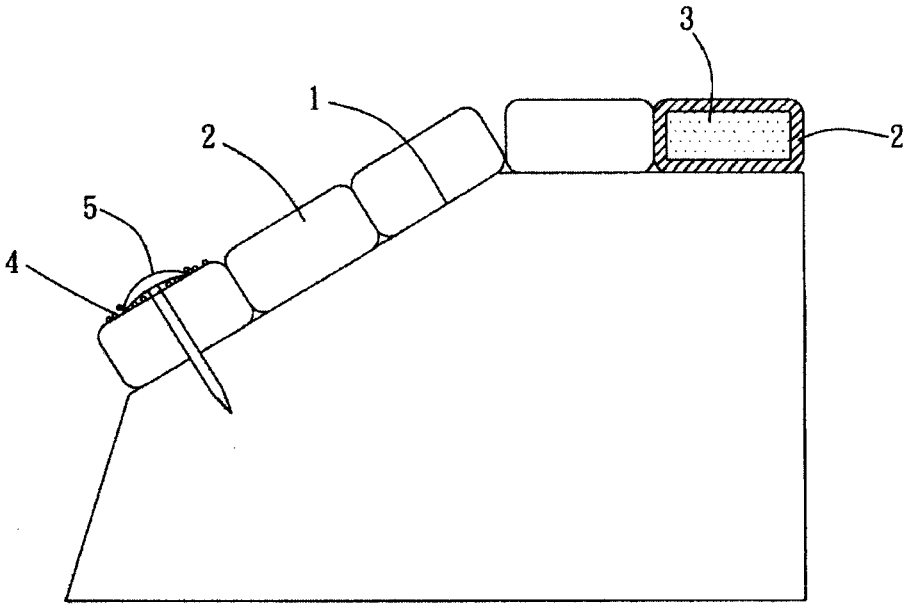
FIG. 2 is a schematic view of a second preferred embodiment of the present invention.

FIG. 2 is a schematic view of a second preferred embodiment of the present invention, which is substantially similar to the first embodiment with the exceptions described hereinafter. The plant seeds 4 are not mixed with the stuffing 3. The plant seeds 4 are sprinkled on the surface of each containing bag 2 after the containing bags 2 are laid on the slope 1. The plant growing material and absorbent material in the stuffing 3 provide essential nutrients and moisture to the plant seeds 4 for sprouting. The roots of the plants will extend downward.

Figure 3:
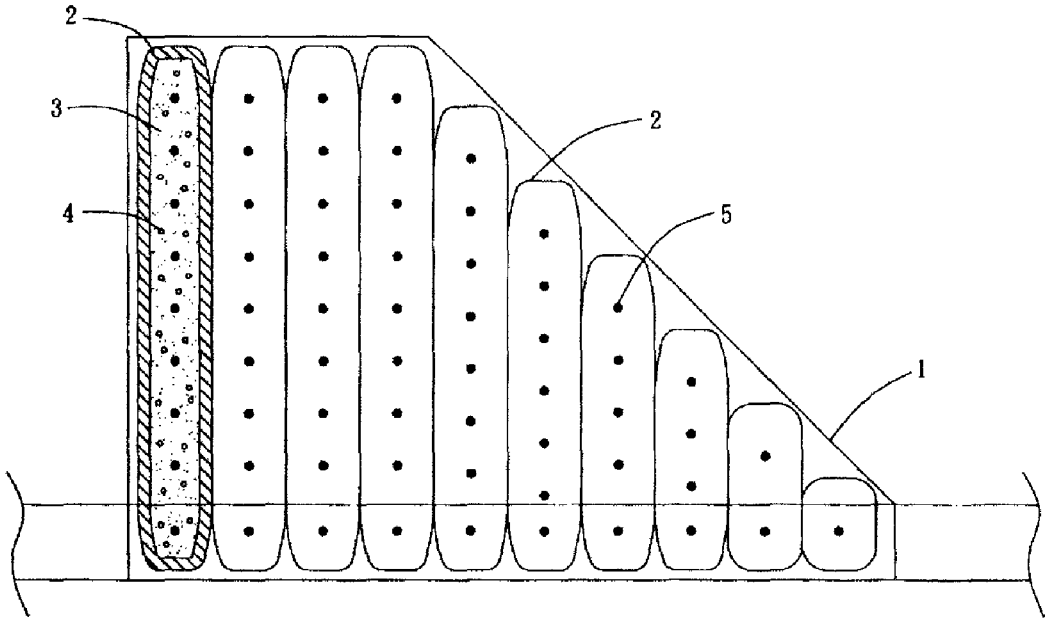
FIG. 3 is a schematic view of a third preferred embodiment of the present invention.
Figure 4:
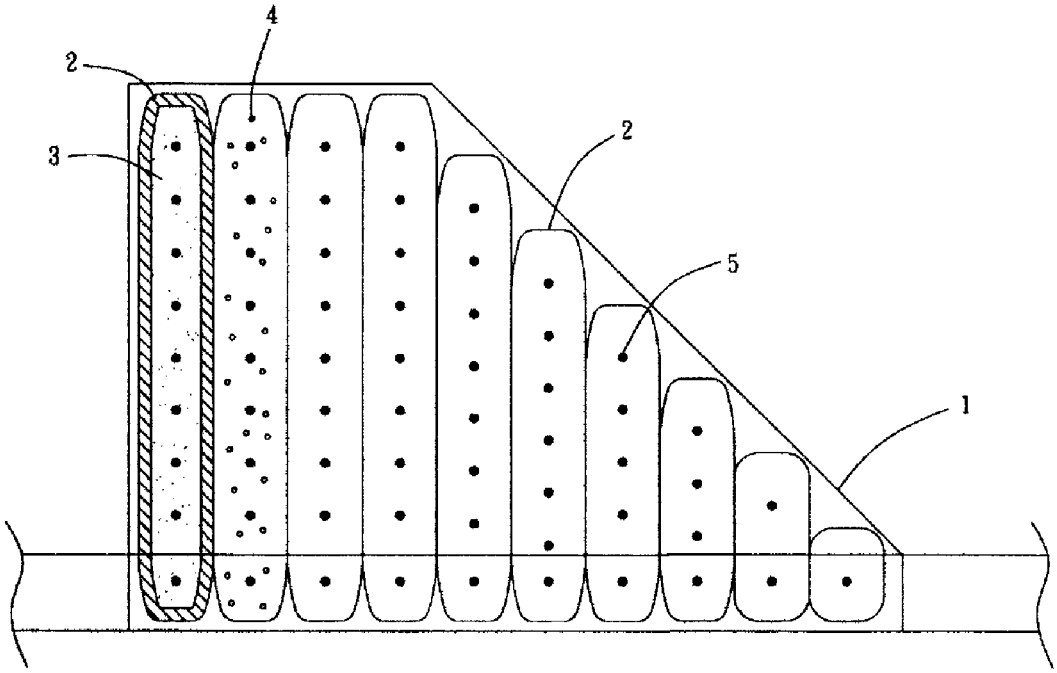
FIG. 4 is a schematic view of a fourth preferred embodiment of the present invention.

FIG. 3 is a schematic view of a third preferred embodiment of the present invention, which is substantially similar to the aforesaid first and second embodiments with the exceptions described hereinafter. The containing bag 2 is made in the form of a unitary rod. The containing bag 2 is arranged from an upper end of the slope 1 to a lower end of the slope 1, and the bottom of the containing bag 2 may be covered with earth (or not be covered with earth). The number of the fasteners 5 depends on the gradient of the slope 1 for enhancing the rod-shaped containing bags 2 integrated to the slope 2. In this embodiment, the plant seeds 4 are mixed with the stuffing 3. The containing bag 2, the stuffing 3, the fasten 5 are the same as the aforesaid embodiments and don¡t be described hereinafter FIG. 4 is a schematic view of a fourth preferred embodiment of the present invention, which is substantially similar to the third embodiment with the exceptions described hereinafter. The plant seeds 4 are not mixed with the stuffing 3. The plant seeds 4 are sprinkled on the surface of each containing bag 2 after the containing bags 2 are laid on the slope 1.

Figure 5:
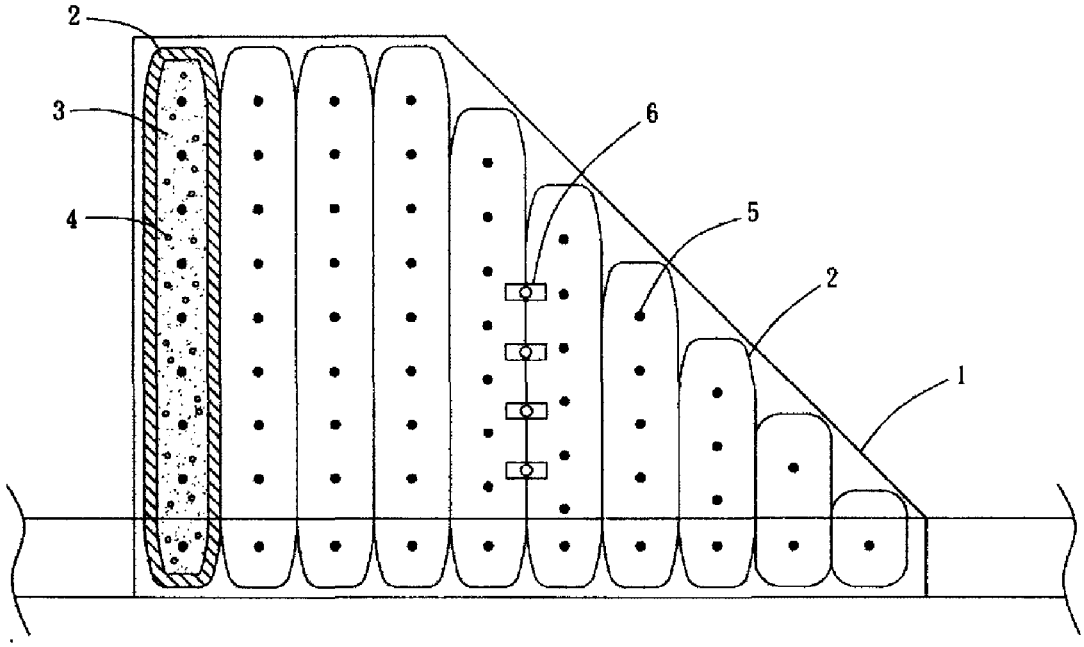
FIG. 5 is a schematic view of a fifth preferred embodiment of the present invention.

FIG. 5 is a schematic view of a fifth preferred embodiment of the present invention, which is substantially similar to the third embodiment with the exceptions described hereinafter. A number of connecting buckles 6 are provided between two adjacent containing bags 2 for connecting the containing bags 2 and integrating the containing bags 2 with the slope 1. In this embodiment, the plant seeds 4 are mixed with the stuffing 3 and then filled into the containing bags 2.

Figure 9A:
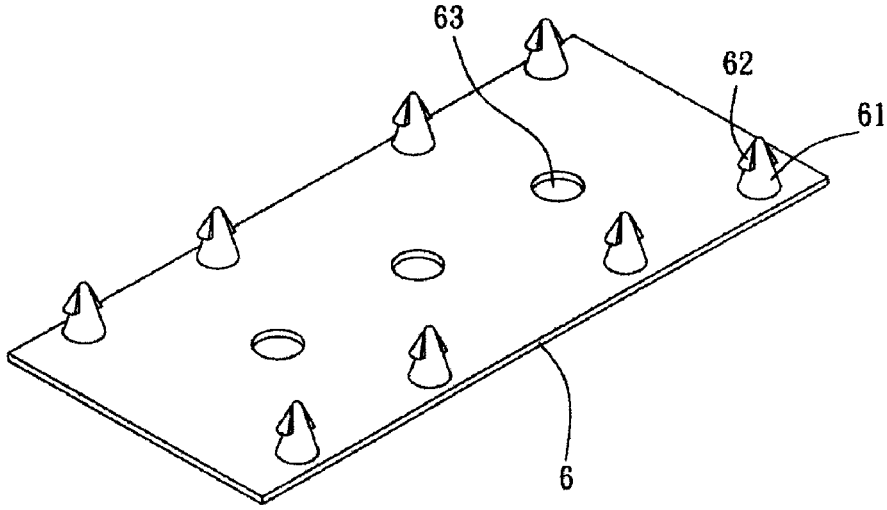
FIGS. 9*a*~9*b* are schematic views of connecting buckles of the present invention.
Figure 9B:
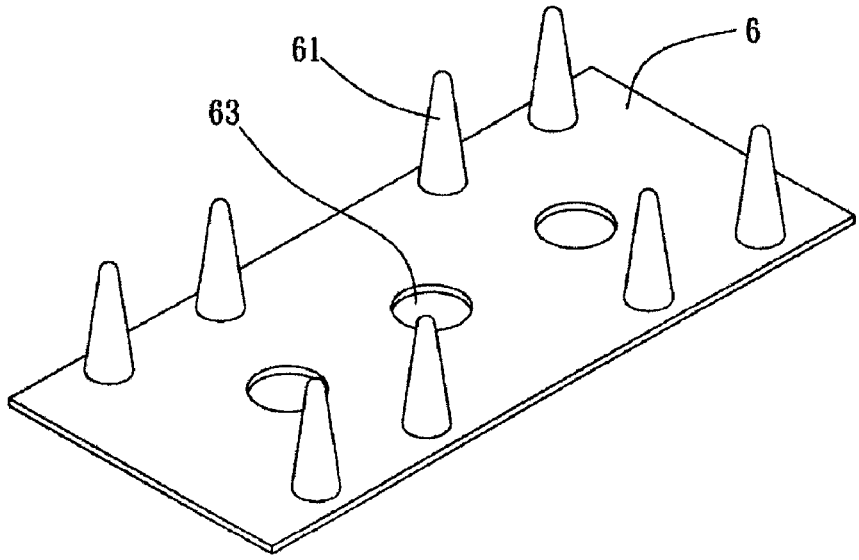

Referring to the FIGS. 9*a* and 9*b*, the connecting buck 6 is a board provided with at least two protrusions 61 for enhancing the connection of the containing bags 2. Each protrusion 61 may be provided with a hook 62. In addition, the connecting buckle 6 may have a hole 63 for insertion of the fastener 5 so that the connecting buckle 6 is fixed on the slope 1 firmly.

Figure 10H:
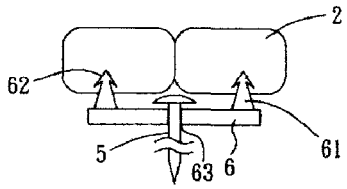
FIGS. 10*a*~10*h* are schematic views of the connections of containing bags and connecting buckles of the present invention.
Figure 10G:
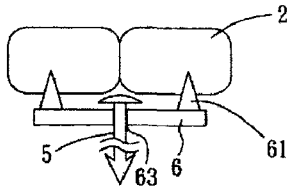
Figure 10F:
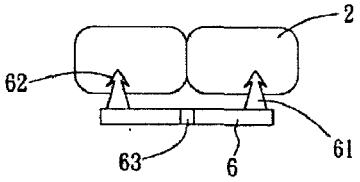
Figure 10E:
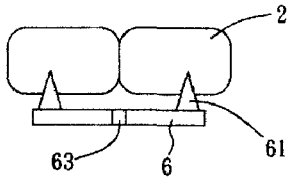
Figure 10D:
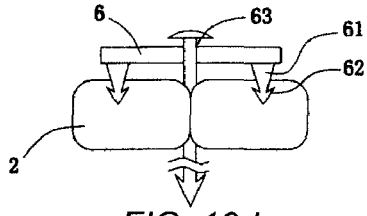
Figure 10C:
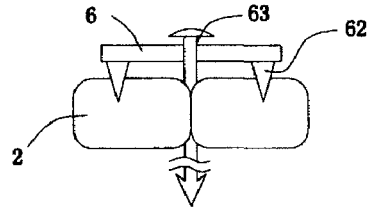
Figure 10B:
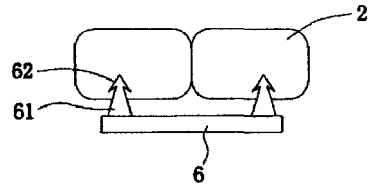
Figure 10A:
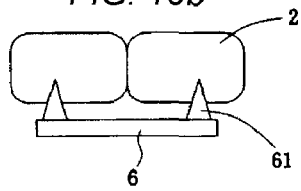

Referring to FIGS. 10*a* and 10*b*, the protrusion 61 or the protrusion 61 having the hook 62 of the connecting buckle 6 without a hole is to connect the bottoms of two adjacent containing bags 2. Referring to FIGS. 10*c* and 10*d*, the protrusion 61 or the protrusion 61 having the hook 62 of the connecting buckle 6 with the hole 63 is to connect the tops of two adjacent containing bags 2. The fastener is inserted through the hole 63 to secure the connecting buckle 6 on the slope 1. Referring to FIGS. 10*e* and 10*f*, the protrusion 61 or the protrusion 61 having the hook 62 of the connecting buckle 6 with the hole 63 is to connect the bottoms of two adjacent containing bags 2. Referring to FIGS. 10*g* and 10*h*, the fastener is inserted through the hole 63 to secure the connecting buckle 6 on the slope 1. The protrusion 61 or the protrusion 61 having the hook 62 is to connect the bottoms of two adjacent containing bags 2.

Figure 6:
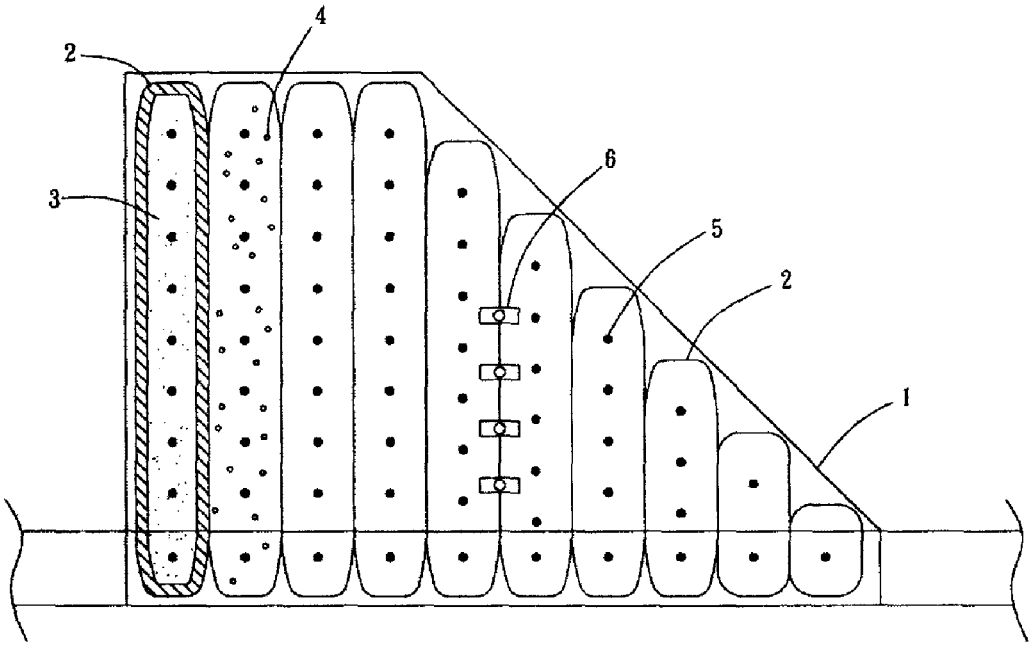
FIG. 6 is a schematic view of a sixth preferred embodiment of the present invention.

FIG. 6 is a schematic view of a sixth preferred embodiment of the present invention, which is substantially similar to the fifth embodiment with the exceptions described hereinafter. The plant seeds 4 are not mixed with the stuffing 3. The plant seeds 4 are sprinkled on the surface of each containing bag 2 after the containing bags 2 are laid on the slope 1.

Furthermore, the plant seeds 4 may be sprinkled in between every two adjacent containing bags 2. This also has the same effects of plant sprouting and growing, and will not be limited.

Figure 7:
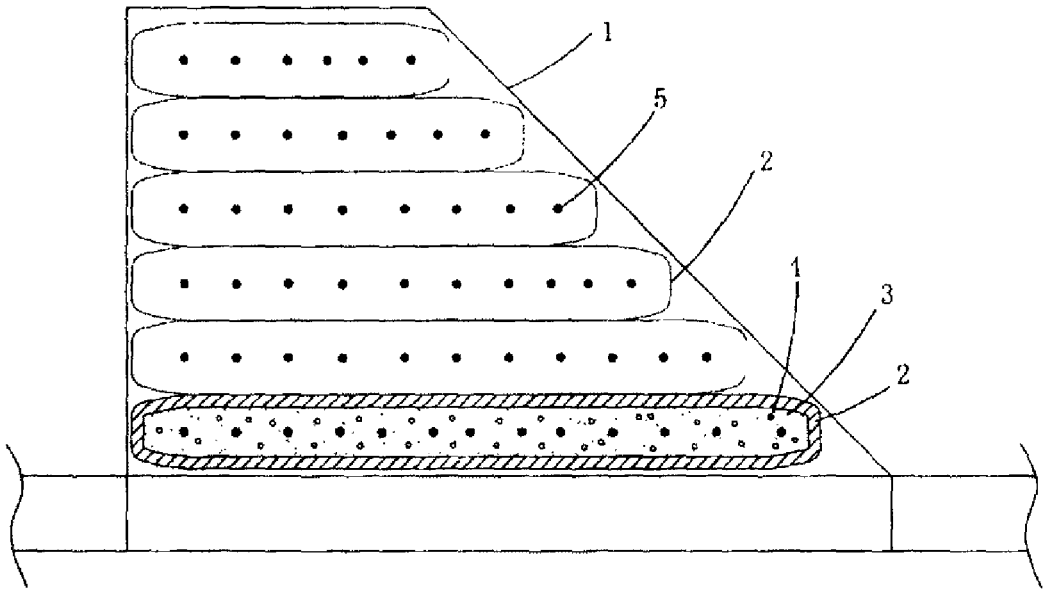
FIG. 7 is a schematic view of a seventh preferred embodiment of the present invention.

FIG. 7 is a schematic view of a seventh preferred embodiment of the present invention, which is substantially similar to the third embodiment with the exceptions described hereinafter. The rod-shaped containing bags 2 are laid transversely from the inclination to the side of the slope 1. In this embodiment, the connecting buckles are also used to connect every two adjacent containing bags, and the arrangement of the plant seeds are the same as the aforesaid embodiments to do difference changes.

As shown in FIGS. 1 through 6, after completing the present invention, the plant growing material and absorbent material in the stuffing 3 need watering to keep moisture for a long time. Even in a drought season, the stuffing 3 is able to provide moisture to the plant seeds 4. The plant seeds 4 sprout and grow up to extend from the top of the containing bag 2, and the roots of the plants extend downward and pass through the bottom of the containing bag 2 into the soil of the slope 1. When the slope 1 is soft material, such as soil, the roots and stems of the plants extend into the soil of the slope 1 to from a permanent natural slope. When the slope 1 is hard material, such as stones and cement, the present invention also provides a green effect. The containing bags 2 adapted for plant growing are integrated with the slope 1, preventing the soil from being washed away and enhancing beauty, environmental protection, ecology and green effects.

The present invention covers an entire slope or a partial slope to provide a green layer for plant growing, securing and protecting the slope as well as greening and beautifying the slope. The materials of the present invention are made of environmental materials, which can be used on any natural slope, such as cement, stone or earth, to provide a green ecology, to improve the air and to absorb heat and noise.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A slope planting structure, comprising containing bags laid on the surface of a slope, stuffing filled in the containing bags, and fasteners, the stuffing comprising plant growing material and being filled into the containing bags, the containing bags being laid on the surface of the slope, the fasteners being inserted through the containing bags to secure the containing bags on the slope, a connecting buckle is provided between only every two of the containing bags for connecting and securing the containing bags transversally, the containing bags being integrated with the slope to secure the slope for providing protection and greening.

2. The slope planting structure as claimed in claim 1, wherein the containing bags are provided with plant seeds, the plant seeds are sprinkled on the surface of the containing bags, mixed with the stuffing and filled into the containing bags, or disposed between every two of the containing bags.

3. The slope planting structure as claimed in claim 2, wherein the containing bags are ventilative and pervious to water.

4. The slope planting structure as claimed in claim 1, wherein the plant growing material of the stuffing is soil or organic soil.

5. The slope planting structure as claimed in claim 1 or claim 4, wherein the stuffing further comprises absorbent material, the absorbent material is absorbent resin.

6. The slope planting structure as claimed in claim 1, wherein each of the fasteners is a bullet head nail, a bulged nail, a spiral nail, or a nail with a spacer.

7. The slope planting structure as claimed in claim 6, wherein each of the fasteners has a hook.

8. The slope planting structure as claimed in claim 1, wherein each of the containing bags is made in the form of a unitary block or a unitary rod.

9. The slope planting structure as claimed in claim 8, wherein the containing bags made in the form of a unitary rod are arranged longitudinally from an upper end of the slope to a lower end of the slope.

10. The slope planting structure as claimed in claim 9, wherein the bottoms of the containing bags are covered with soil.

11. The slope planting structure as claimed in claim 8, wherein the containing bags made in the form of a unitary rod are arranged transversally from an inclination of the slope to a side of the slope.

12. The slope planting structure as claimed in claim 1, wherein the connecting buckle having a central hole comprises a protrusion with a hook or without a hook, alternatively, the connecting buckle without a hole comprises a protrusion with a hook or without a hook, the protrusion being adapted to connect the tops or the bottoms of every two of the containing bags.

13. The slope planting structure as claimed in claim 12, the central hole of the connecting buckle is adapted for insertion of the fastener.

14. A slope planting structure, comprising containing bags laid on the surface of a slope, stuffing filled in the containing bags, and fasteners, the stuffing comprising plant growing material and being filled into the containing bags, the containing bags being laid on the surface of the slope, the fasteners being inserted through the containing bags to secure the containing bags on the slope, a connecting buckle is provided between every two of the containing bags for connecting and securing the containing bags transversally, the connecting buckle being a board with at least two protrusions, the containing bags being integrated with the slope to secure the slope for providing protection and greening.

* * * * *